US007588390B2

(12) United States Patent
Kelley

(10) Patent No.: US 7,588,390 B2
(45) Date of Patent: Sep. 15, 2009

(54) WAVE ATTENUATOR STRUCTURE AND SYSTEM THEREFOR

(76) Inventor: Dennis G. Kelley, 148 Thompson Rd., Suite 2, Houma, LA (US) 70363

( * ) Notice: Subject to any disclaimer, the term of this patent is extended or adjusted under 35 U.S.C. 154(b) by 0 days.

(21) Appl. No.: 11/952,546

(22) Filed: Dec. 7, 2007

(65) Prior Publication Data

US 2008/0138155 A1 Jun. 12, 2008

Related U.S. Application Data

(60) Provisional application No. 60/869,340, filed on Dec. 10, 2006.

(51) Int. Cl.
*E02D 29/02* (2006.01)

(52) U.S. Cl. ..... 405/31; 405/262; 405/284; 405/21

(58) Field of Classification Search ..... 405/31, 405/284, 285, 286, 262, 21, 25
See application file for complete search history.

(56) References Cited

U.S. PATENT DOCUMENTS 3,913,333 A * 10/1975 Hubbard, Jr. ..... 405/31
4,498,805 A * 2/1985 Weir ..... 405/31
4,666,334 A * 5/1987 Karaus ..... 405/31
4,690,588 A * 9/1987 Berger ..... 405/284
4,776,725 A * 10/1988 Brade ..... 405/31
5,125,765 A * 6/1992 Verble ..... 405/31
5,697,736 A * 12/1997 Veazey et al. ..... 405/284
6,659,686 B2 * 12/2003 Veazey ..... 405/16
6,908,258 B2 * 6/2005 Timmerman ..... 405/31
2003/0091391 A1 * 5/2003 Veazey ..... 405/16
2004/0244667 A1 * 12/2004 Veazey ..... 114/258
2005/0008439 A1 * 1/2005 Timmerman ..... 405/284
2005/0042038 A1 * 2/2005 Irvine ..... 405/31

* cited by examiner

*Primary Examiner*—Frederick L Lagman
(74) *Attorney, Agent, or Firm*—McGlinchey Stafford, PLLC

(57) ABSTRACT

A wave attenuator structure for dissipation of wave energy of a body of water is described. The structure preferably is equipped with a substantially horizontal base, a foot extending substantially vertically downward from the base, and a wall extending substantially vertically upward from the base. The wall forms a water-facing face, which face slopes in the direction of the body of water. The wall and the base define a plurality of channels sized and configured to receive one or more respective anchor devices for anchoring the wave attenuator structure in soil.

18 Claims, 4 Drawing Sheets

WAVE ATTENUATOR STRUCTURE AND SYSTEM THEREFOR

REFERENCE TO RELATED APPLICATION

This Application claims the benefit of provisional patent application No. 60/869,340, filed Dec. 10, 2006, the disclosure of which is incorporated herein by reference.

TECHNICAL FIELD

This invention relates to a wave attenuator structure for improving performance of levees and levee systems.

BACKGROUND

Certain areas of the country which border rivers and/or gulfs or oceans have been protected from the devastating effects of floods and storm surges through construction of miles of inland levee systems. Such construction is expensive and ongoing. While occurrence of natural disasters such as 100 year floods and 100 year hurricanes is unpredictable at best, protection must be afforded to lives and property of the population which can be affected by these disasters. Much of the present levee system, for example that built to protect the low-lying areas of southern Louisiana, has been judged to be in need of re-engineering or improvement.

My provisional application, U.S. Ser. No. 60/814,106, filed Jun. 14, 2006, all disclosure of which is incorporated herein by reference, relates to one approach for levee construction using geotextile material. A need continues to exist for a relatively quick, efficient way to mitigate the damaging force of storm surges to vulnerable low-lying areas behind existing or new levee systems.

SUMMARY OF THE INVENTION

The present invention meets these and other needs by providing, among other things, a wave attenuator structure for dissipation of wave energy of a body of water, which structure comprises a substantially horizontal base, a foot extending substantially vertically downward from the base, and a wall extending substantially vertically upward from the base, wherein the wall forms a water-facing face, which face slopes in the direction of the body of water, and wherein the wall and the base define a plurality of channels sized and configured to receive one or more respective anchor devices for anchoring the wave attenuator structure in soil. Typically the wave attenuator structure is placed on the crown or upper most surface of an existing or newly constructed levee. Other embodiments of the invention provide a wave attenuator structure wherein the base forms a top surface, which top surface slopes away from the body of water and a structure wherein a portion of the water-facing face of the wall has convex curvature near the base.

In another embodiment of the invention the wall forms two ends, and each end is sized and configured for disposition of a spacer. The spacer is preferably constructed of HDPE (high density polyethylene) and serves to allow for differential settlement between two wave attenuator structures which are linked in series.

An embodiment of the invention provides that the wall defines at least one passageway sized and configured to receive at least one post-tensioning cable. When a series of wave attenuator structures are linked together, the same post-tensioning cable is passed through passageways of more than one structure before force is applied to the post-tensioning cable to put the structures in a state of compression, In a further embodiment of the invention the channels of the wave attenuator structure are further defined by pipe inserts.

Another embodiment of the invention provides a wave attenuator system for dissipation of wave energy of a body of water, which system comprises i) a plurality of wave attenuator structures, wherein each structure comprises a substantially horizontal base, a foot extending substantially vertically downward from the base, and a wall extending substantially vertically upward from the base, wherein the wall forms a water-facing face, which face slopes in the direction of the body of water, wherein the wall and the base define a plurality of channels sized and configured to receive one or more respective anchor devices for anchoring the wave attenuator structure in soil, and wherein the base forms a water-opposed portion;

ii) a plurality of spacers sized and configured to be disposed between two respective wave attenuator structures;

iii) a splash zone protectant sized and configured to be disposed in contact with a plurality of bases at the water-opposed portions thereof, and iv) a plurality of anchor devices for anchoring the plurality of wave attenuator structures in soil, each of the plurality of anchor devices comprising an anchor cable and a soil anchor, which anchor cable is sized and configured for placing into a respective one of the channels defined by the wall and the base.

Another embodiment of the invention provides that the system comprises a cement stabilized soil beneath and in contact with the splash zone protectant and beneath and in contact with the plurality of wave attenuator structures.

One embodiment of the invention provides that the foot forms a water-opposed face, the wall forms a water-opposed face, and the water-opposed faces of the foot and of the wall are coplanar.

An additional embodiment of the invention provides a method for assembling a wave attenuator system for dissipation of wave energy of a body of water, which method comprises A) placing a plurality of wave attenuator structures, wherein each structure comprises a substantially horizontal base, a foot extending substantially vertically downward from the base, and a wall extending substantially vertically upward from the base, wherein the wall forms a water-facing face, which face slopes in the direction of the body of water, wherein the wall and the base define a plurality of channels sized and configured to receive one or more respective anchor devices for anchoring the wave attenuator structure in soil, and wherein the base has a water-opposed portion, such that the water-facing face of the wall faces a body of water;

B) placing a plurality of spacers between the wave attenuator structures such that each spacer is disposed between the walls of two adjacent wave attenuator structures, which spacers are sized and configured to be disposed between two wave attenuator structures;

C) placing a splash zone protectant in contact with a plurality of bases, which splash zone protectant is sized and configured to be disposed in contact with a plurality of the bases at the water-opposed portions thereof, and D) placing each of a plurality of anchor devices in a respective one of the channels in a wave attenuator structure, attaching each anchor device to the wave attenuator structure comprising the respective channel, and securing the anchor device in soil.

The various embodiments and features of this invention will now become apparent from the following detailed description, the accompanying drawings and the appended claims.

BRIEF DESCRIPTION OF THE DRAWINGS

In each of the above figures, like numerals or letters are used to refer to like parts among the several figures.

FURTHER DETAILED DESCRIPTION OF THE INVENTION

An innovative design concept is provided that uses wave attenuators which can be levee extenders to dissipate broken waves and direct the energy of the wave upwards and away from the levee crown. These levee extenders are constructed of concrete and can be removed during levee raising events and replaced afterward.

Figure 1:
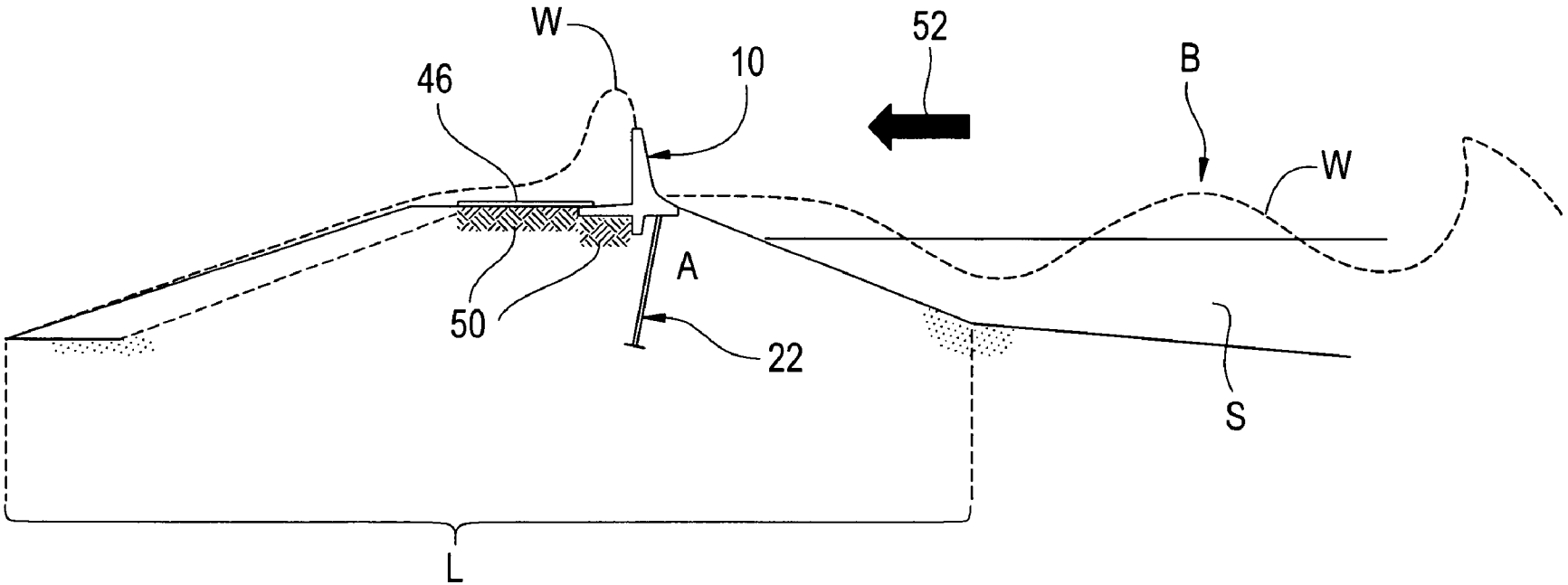
FIG. 1 is a cross-sectional view of a levee, bordering a body of water, which has an embodiment of the present invention installed.

Turning now to the drawings, FIG. 1 illustrates one embodiment of this invention. There, a wave attenuator structure 10 is shown installed at the crown of an existing levee L. Levee L borders directly a body of water B. While body of water B normally maintains a still water elevation S which is safely below the top of levee L, during severe storms or floods, storm surge-type waves W can be generated which over-top the existing levee system causing severe wave action damage such as levee scour and erosion to the protected side of the levee. Wave attenuator structure 10 is designed to resist and survive design forces from anticipated wave action during an one hundred year design storm. Wave attenuator structure 10 dissipates the energy of the breaking significant wave and the energy from broken waves larger than a significant wave. The significant wave, for levees in some areas of Louisiana has been established by the United States Army Corps of Engineers (USACE). The significant wave for certain levee reaches has been established to have an amplitude of approximately 6 to 10 ft. The design impact forces are established by the impact of the breaking waves lower in height than the significant waves plus the momentary hydrostatic and hydrodynamic forces imparted by the larger than or equal to the significant wave that were broken when passing over the wave berm on the unprotected side of the levee.

Wave attenuator structure 10 is preferably a pre-cast, steel reinforced concrete barrier anchored to levee L which structure is designed to be cast in 12 ft. lengths.

Wave attenuator structure 10 is sized and configured to structurally withstand anticipated forces of waves, dissipate the horizontal kinetic energy of breaking and broken waves, to direct this energy vertically and to transmit these forces to the levee crown and upper design section of the levee. Anchor devices 22, comprising anchor cables 54 attached to soil anchors 56, are used to anchor wave attenuator structure 10 into soil A, usually at relatively great depths in a range of about 6 to about 8 ft., and preferably in a range of about 7 to about 8 ft. Anchor devices 22 are sized and configured to resist the overturning moments of force due to the horizontal forces imparted to wave attenuator structure 10 by the wave forces. Anchor cables 54 are typically constructed of steel and are about ½ in. or less in diameter.

Another feature of an embodiment of the invention is placing a layer of cement stabilized soil 50, also known as soil cement, in the upper 12 to 18 in. region of the crown of levee L. Cement stabilized soil 50 is formed by mixing (A) select soil of good cohesive quality with (B) cement in a proportion established by laboratory testing, that produces a treated soil with a strength well in excess of 1500 psf (pounds per square foot). Such cement stabilized soil can also be reinforced using fibers such as plastic-based fibers such as those used in concrete reinforcement. Having cement stabilized soil which is optionally further treated by being compacted to greater than 90% standard Proctor Density, produces a soil layer under wave attenuator structure 10 which has shear strengths (cohesion) well in excess 1500 psf (pounds per square foot). The standard Proctor Density is determined according to ASTM procedure D698.

A further feature of an embodiment of the invention as seen in FIG. 1 is disposition of an optional splash zone protectant 46, which is disposed so as to overlap to some extent wave attenuator structure 10 and to extend from wave attenuator structure 10 across the crown of levee L, on the water-protected side of wave attenuator structure 10. The splash zone protectant can be constructed of flexacrete splash pavement (also known as an "apron") which is described more fully in U.S. Pat. Appln. No. 60/814,106. The splash zone protectant can also be constructed of fiber-reinforced concrete. Splash zone protectant 46 is laid on top of cement stabilized soil 50, as is a portion of wave attenuator structure 10.

Arrow 5 shows the direction of horizontal wave movement of wave W against wave attenuator structure 10.

Figure 2:
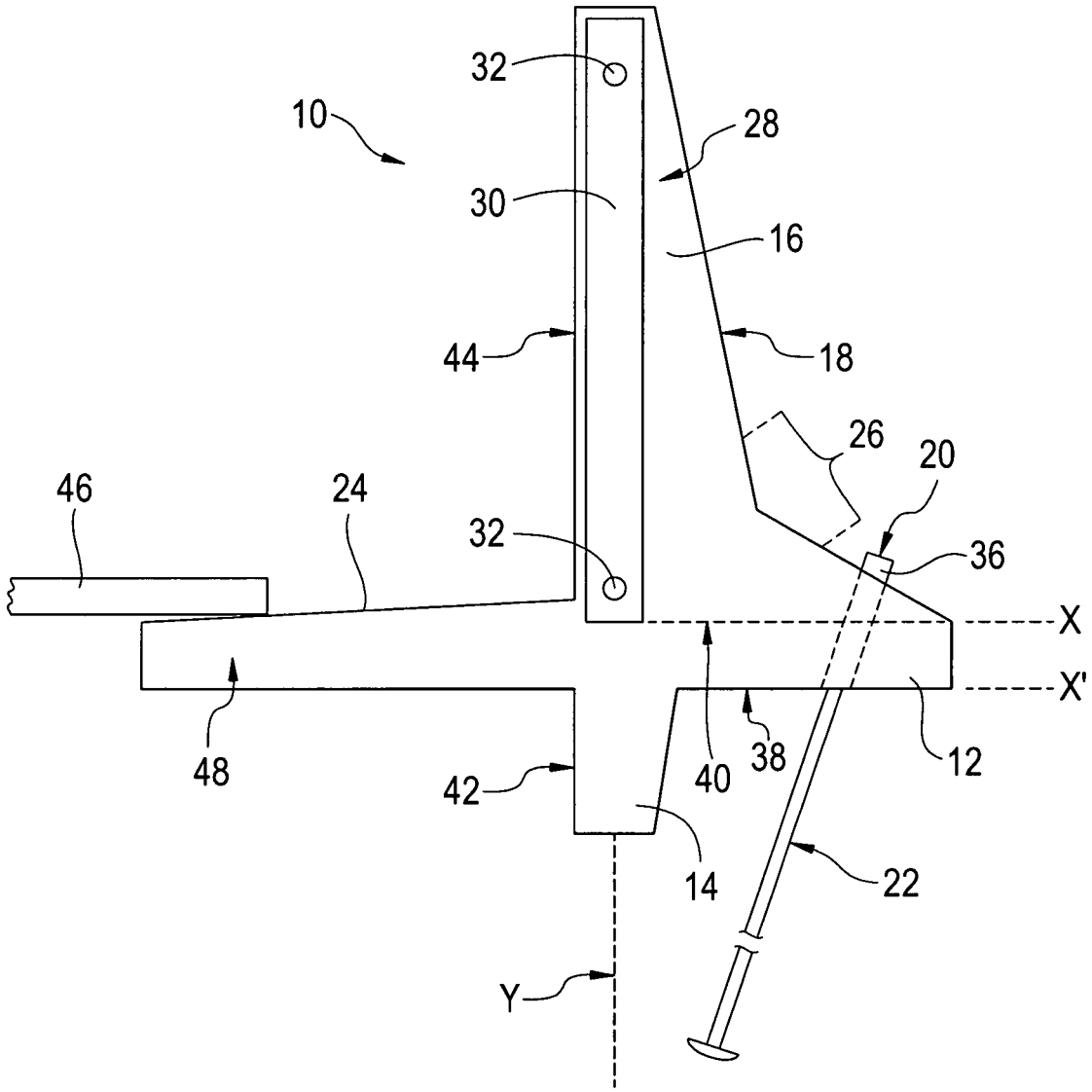
FIG. 2 is an end view in cross section of an embodiment of the invention.

As seen in another embodiment of the invention illustrated in FIG. 2, wave attenuator structure 10 comprises a substantially horizontal base 12. A foot 14 extends substantially vertically downward from base 12 while a wall 16 extends substantially vertically upward from base 12.

It will be understood that the term "substantially" denotes that the subject matter referred to need not involve absolutes. Thus substantially vertically, for example, is suitably close to being truly vertical It is more realistic to have something substantially vertical or otherwise aligned, since in the practice of this invention, micrometer alignment is not necessary; tolerances typically exist. Since substantially is in common usage and is well-defined in the dictionary, it is deemed sufficiently precise and is thus used herein.

Height of the wall and base combined is in the range of about 4 to about 7 ft. and preferably in the range of about 4.7 to about 6.7 ft. The height of the foot is in the range of about 1 to about 1.5 ft. The thickness of the wave attenuator structure at the widest part of the base measured from the water-facing side to the water-opposing side is in the range of about 4 to about 7 ft., and preferably in the range of about 4.7 to about 6.7 ft. The length of the wave attenuator structure is about 12 ft. so that when joined together, end-to-end, a typical 4-unit series of wave attenuator structures has an overall length of about 48 ft.

Turning again to FIG. 2, it can be seen that wall 16 forms a water-facing face 18 which slopes in the direction of body of water B (shown in FIG. 1). Wall 16 and base 12 define a plurality of channels 20. As may be seen in phantom line, channel 20 extends through wall 16 and base 12. Channel 20 is sized and configured to receive anchor cable 22 for anchoring wave attenuator structure 10 in soil A (as seen in FIG. 1).

Base 12 forms a top surface 24 which slopes away from the body of water. Splash zone protectant 46 is shown disposed in contact with base 12 at a water-opposed portion 48 formed by base 12.

A portion 26 of water-facing face 18 of wall 16 is sized configured to have a convex curvature near base 12.

In an embodiment of the invention, channel 20 is further defined by pipe insert 36, preferably constructed of 1 in., interior diameter, schedule 40 PVC (polyvinyl chloride) pipe. Channel 20 and anchor cable 22 are positioned at an angle downward and toward an imaginary longitudinally extended axis Y of wave attenuator structure 10. The angled configuration serves to counteract wave forces that tend to dislocate wave attenuator structure 10.

Wall 16 forms ends 28 which are sized and configured for disposition of a spacer 30. Wall 16 also defines passageways 32, 32 which are sized and configured to receive a post-tensioning cable 34 (best seen in FIG. 3). Spacer 30 also defines apertures which are aligned with passageways 32, 32 to allow receipt and positioning of post-tensioning cable 34.

Spacers are preferably constructed of PVC or HDPE and have a typical cross-section dimension of 3 in. by 3 in. The length of spacers varies with the height of the wall. The approximately 12 ft. long wave attenuator structure will be joined end-to-end with the flexible spacer set into slots pre-cast in the ends of the wave attenuator structure. These flexible spacers allow for freedom of movement between structures during consolidation (or settling/compacting) of the levee soil, yet the spacers restrict flow of water between structures during storm events.

Base 12 forms a bottom portion 38 and wall 16 forms a bottom portion 40. Bottom portion 38 of base 12 and bottom portion 40 of wall 16 occupy parallel but offset imaginary planes X and X', respectively. Foot 14 forms a water-opposed face 42 which is coplanar with a water-opposed face 44 of wall 16.

Figure 3:
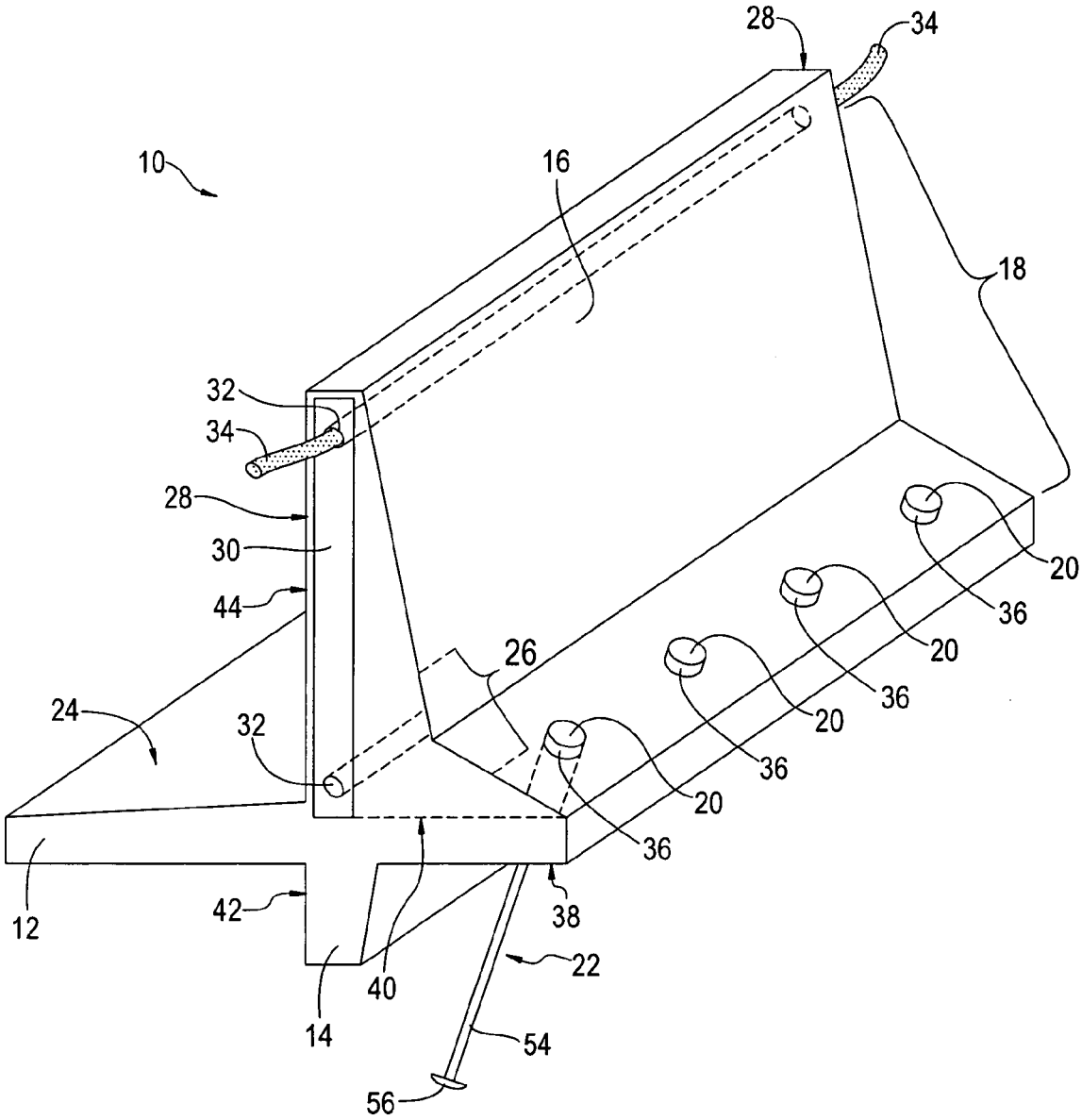
FIG. 3 is a view in perspective of an embodiment of the invention.

FIG. 3 is shown having one post-tensioning cable 34 extending from passageway 32 which extends internally through wall 16 and opens at ends 28, 28 of wall 16.

A post-tensioning cable is understood to be a cable, usually of sleeve-covered steel, being 7-strand and about ½ in. in diameter, which is stretched or "tensioned" after insertion into one or more wave attenuator structures. The cable is stretched by having force applied to at least one end of the cable, sometimes both ends, so that the concrete of which the wave attenuator structure is constructed is placed in a state of compression.

Though only one post-tensioning cable 34 is shown in FIG. 2, it is to be understood that typically the lower passageway 32 also contains a post-tensioning cable. Also, a plurality of wave attenuator structures, usually a group of 4, will be aligned end-to-end, and one length of post-tensioning cable will be passed through a passageway of all wave attenuator structures. This is repeated in the other passageway. The post-tensioning force is then applied to all 4 wave attenuator structures.

One series of wave attenuator structures, having been post-tensioned, can be attached to another series by attaching the ends of respective post-tensioning cables to each other, for example, by use of a clamp.

In the alternative, the post-tensioning can be done to a single wave attenuator structure and the series can be linked by attaching the wave attenuator structures at the respective post-tensioning cables.

Channels 20, 20 are shown in this embodiment disposed in wall 16 and base 12 with channels 20, 20 located about 4 ft. apart, center-to-center. When anchor device 22 extends to a depth in the soil in a range of from 4 to 7 ft. and there are a minimum of 4 anchor devices provided. The anchors will be sized to produce an anchor force resistance with a factor of safety of 1.5.

Figure 4:
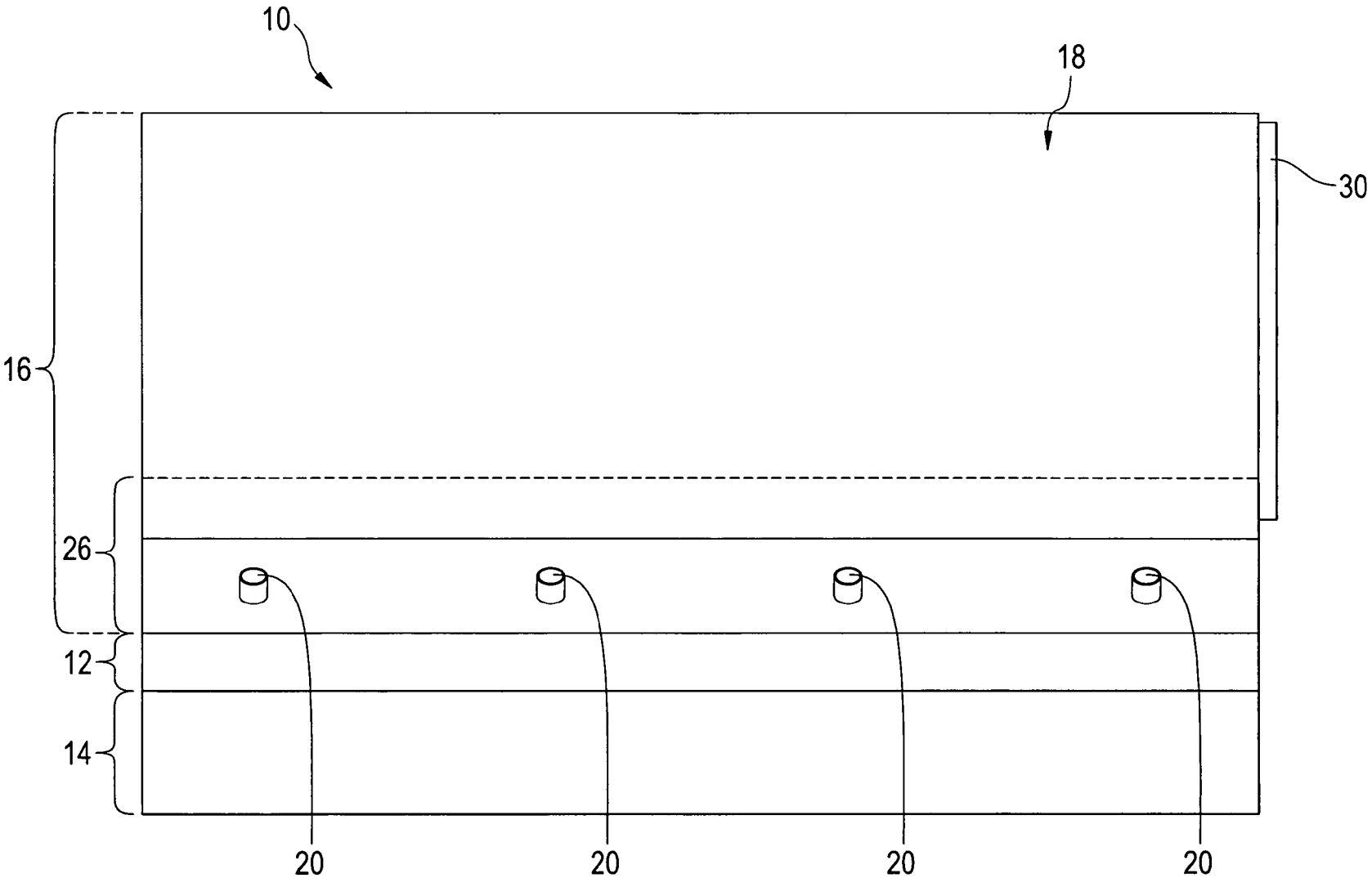
FIG. 4 is a front view of the water-facing side of an embodiment of the invention.

FIG. 4 illustrates an embodiment of the invention viewed from a water-facing side of wave attenuator structure 10, with 4 evenly spaced channels 20, 20.

It is also possible to develop and utilize light levee reinforcement or armament in conjunction with the wave attenuators for levee protection. The "light" armament concept does not refer to "weak" armament, but to the weight of the armament. The armament comprises heavy duty turf armament in those places on the levee section where vegetation can be established. In those places on the levee section where there are water impact forces or where there are very erosive forces like areas of hydraulic jump, a flexible grout or plastic turf-reinforced sand-cement matrix, flexacrete, is used in place of concrete articulated block or rip-rap alternatives. In this context, hydraulic jump refers to a zone where the velocity of the water passing down the back side of the levee passes from supercritical flow to sub-critical flow and where a great deal of erosive energy is released. This zone usually occurs at areas where the slope of the back side of the levee transitions abruptly from one unit vertical to three units horizontal to one unit vertical to twenty or more units horizontal, while the term "rip-rap" refers to any natural rock or concrete material is placed in areas of high erosive energy to dissipate that energy and protect the levee or soil structure.

In the practice of this invention, a number of pre-cast wave attenuator structures are prepared in groups of 4 and post-tensioning stress is applied to installed post-tensioning cables on each structure. The levee crown is prepared to receive the wave attenuator structures. This is accomplished by adding from about 12 to about 18 in. of cement stabilized soil on the protected side of the levee crown.

A key way is cut into the crown of the levee, which levee is in need of additional wave damage protection. The key way (or trench) will accept the foot of the wave attenuator structure. Soil anchors attached to anchor cables are carefully positioned, driven into the soil at the correct angle and depth and ends of the anchor cables are left extending from the soil.

The wave attenuator structure is lowered into the key way on top of the cement stabilized soil with the water-facing face of the wall properly oriented to the anticipated wave direction. The lowering must be carefully accomplished, since the anchor cables must be threaded through the pipe inserts of the channels.

The anchor cables are then set, by applying a pulling force on the exposed ends of the anchor cables at the channel openings of the wave attenuator structure.

The process is repeated for several more wave attenuator structures. A spacer is inserted between each pair of wave attenuator structures. The wave attenuator structures are connected by attaching ends of respective post-tensioning cables.

Alternatively, a series of 4 wave attenuator structures is set in place, post-tensioning cables are inserted respectively through the upper and lower passageways for all wave attenuator structures in the series. Post-tensioning force is applied to the post-tensioning cables to stress the concrete of the wave attenuator structures.

A splash zone protectant, such as flexacrete or fiber-reinforced concrete, is then installed on the water-opposed side of the levee so that it overlaps somewhat with the water-opposed portion of the base.

I claim:

1. A wave attenuator system for dissipation of wave energy of a body of water, which system comprises i) a plurality of wave attenuator structures, wherein each structure comprises a substantially horizontal base, a foot extending substantially vertically downward from the base, and a wall extending substantially vertically upward from the base, wherein the wall forms a water-facing face, which face slopes in the direction of the body of water, wherein the wall and the base define a plurality of channels sized and configured to receive one or more respective anchor devices for anchoring the wave attenuator structure in soil, and wherein the base forms a water-opposed portion;

ii) a plurality of spacers sized and configured to be disposed between two respective wave attenuator structures;

iii) a splash zone protectant sized and configured to be disposed in contact with a plurality of bases at the water-opposed portions thereof; and iv) a plurality of anchor devices for anchoring the plurality of wave attenuator structures in soil, each of the plurality of anchor devices comprising an anchor cable and a soil anchor, which anchor cable is sized and configured for placing into a respective one of the channels defined by the wall and the base.

2. A system as in claim 1 wherein a portion of the water-facing face of the wall has convex curvature near the base.

3. A system as in claim 1 wherein the foot forms a water-opposed face, the wall forms a water-opposed face, and the water-opposed faces of the foot and of the wall are coplanar.

4. A system as in claim 1 wherein a portion of the water-facing face of the wall has convex curvature near the base.

5. A system as in claim 1 wherein the spacers are formed from high density polyethylene material.

6. A system as in claim 1 wherein the splash zone protectant is a flexacrete apron or fiber-reinforced concrete.

7. A system as in claim 1 wherein the wall forms two ends, and each end is sized and configured for disposition of a spacer.

8. A system as in claim 1 wherein the wall defines at least one passageway sized and configured to receive at least one post-tensioning cable.

9. A system as in claim 1 which further comprises a cement stabilized soil beneath and in contact with the splash zone protectant and beneath and in contact with the plurality of wave attenuator structures.

10. A method for assembling a wave attenuator system for dissipation of wave energy of a body of water, which method comprises A) placing a plurality of wave attenuator structures on top of a levee structure, wherein each structure comprises a substantially horizontal base, a foot extending substantially vertically downward from the base, and a wall extending substantially vertically upward from the base, wherein the wall forms a water-facing face, which face slopes in the direction of the body of water, wherein the wall and the base define a plurality of channels sized and configured to receive one or more respective anchor devices for anchoring the wave attenuator structure in soil, and wherein the base has a water-opposed portion, such that the water-facing face of the wall faces a body of water;

B) placing a plurality of spacers between the wave attenuator structures such that each spacer is disposed between the walls of two adjacent wave attenuator structures, which spacers are sized and configured to be disposed between two wave attenuator structures;

C) placing a splash zone protectant in contact with a plurality of bases, which splash zone protectant is sized and configured to be disposed in contact with a plurality of the bases at the water-opposed portions thereof; and D) placing each of a plurality of anchor devices into a respective one of the channels in a wave attenuator structure, attaching each anchor device to the wave attenuator structure comprising the respective channel, and securing the anchor device in soil.

11. A method as in claim 10 wherein a portion of the water-facing face of the wall has convex curvature near the base.

12. A method as in claim 10 wherein the foot forms a water-opposed face, the wall forms a water-opposed face, and the water-opposed faces of the foot and of the wall are coplanar.

13. A method as in claim 10 wherein a portion of the water-facing face of the wall has convex curvature near the base.

14. A method as in claim 10 wherein the splash zone protectant is a flexacrete apron or fiber-reinforced concrete.

15. A method as in claim 10 wherein the wall forms two ends, and each end is sized and configured for disposition of a spacer.

16. A method as in claim 10 which further comprises, prior to placing the wave attenuator structures and the splash zone protectant, placing a cement stabilized soil for contact with the splash zone protectant and with a plurality of bases.

17. A method as in claim 10 further comprising passing at least one post-tensioning cable through at least one passageway defined by the wall and applying force to the post-tensioning cable thereby placing the wave attenuator structure in a state of compression.

18. A method as in claim 17 wherein the post-tensioning cable passes through passageways of two or walls prior to applying a force to the post-tensioning cable.

* * * * *